US005165537A

United States Patent [19]

Neff et al.

[11] Patent Number: 5,165,537

[45] Date of Patent: Nov. 24, 1992

[54] DISPLAY AND CARRYING CASE FOR DARTS

[75] Inventors: Paul A. Neff, Pascoag, R.I.; Donald Amirault, Lynn; John J. Petell, Worcester, both of Mass.

[73] Assignee: Dart World Inc., Lynn, Mass.

[21] Appl. No.: 695,684

[22] Filed: May 3, 1991

[51] Int. Cl.[5] ..... B65D 85/24

[52] U.S. Cl. ..... 206/315.1; 206/443; 206/493

[58] Field of Search ..... 206/315.1, 443, 493, 206/579; 273/416

[56] References Cited

U.S. PATENT DOCUMENTS

| | | | |
|---|---|---|---|
| 2,964,166 | 12/1960 | Lehner et al. | 206/315.1 |
| 3,151,741 | 10/1964 | Haecker | 206/579 |
| 3,301,386 | 1/1967 | Carter | 206/579 |
| 3,960,271 | 6/1976 | Nelson | 206/315.1 |
| 4,105,119 | 8/1978 | Cowan | 273/416 |
| 4,133,427 | 1/1979 | Loomis | 273/416 |
| 4,294,365 | 10/1981 | Henderson | 206/315.1 |
| 4,413,731 | 11/1983 | Weideman | 206/443 |
| 4,573,569 | 3/1986 | Parker | 206/443 |
| 4,773,578 | 9/1988 | Braun | 206/315.1 |

FOREIGN PATENT DOCUMENTS

| | | | |
|---|---|---|---|
| 1342597 | 1/1974 | United Kingdom | 206/315.1 |
| 1429798 | 3/1976 | United Kingdom | 206/315.1 |
| 2225569 | 6/1990 | United Kingdom | 206/315.1 |

*Primary Examiner*—Jimmy G. Foster
*Attorney, Agent, or Firm*—Paul J. Cook

[57] ABSTRACT

A dart carrying and display case is prvovided with an insert having lower troughs for housing dart flights and an upper trough for housing a plurality of darts. The points of the darts are positioned within a dart block. The body segments of the darts are separated by knobs formed integrally with the inserts. A rod-like structure is passed through shaft segments of the darts to maintain the darts separated from each other and away from the cover of the case.

7 Claims, 2 Drawing Sheets

DISPLAY AND CARRYING CASE FOR DARTS

BACKGROUND OF THE INVENTION

This invention relates to a case useful for carrying and displaying darts. More particularly, this invention relates to a display and carrying case for darts which permits shipment from the point of manufacture and for use by the owner while preventing the darts or dart components from moving within the case.

Prior to the present invention, darts have been shipped from the point of manufacture in cases containing a foam polymeric or rubber insert having the intended function of immobilizing the darts within the case to prevent dart damage during shipment. The use of foam inserts is undesirable since they must be removed in order to display the darts for viewing by potential purchasers. In addition, the use foam inserts has been ineffective since the darts, which are formed of attachable dart segments, become separated and the dart segments are free to move within the case. This movement can easily cause damage to both the darts and the case. The case also is undesirable since the case must be opened in order to display the darts. This case is undesirable since the foam must be removed prior to displaying the darts. This requirement of opening the case compromises the integrity of the dart product as well as being time consuming and expensive.

It has been proposed in U.S. Pat. No. 3,960,271 to provide a dart carrying case wherein the darts are inserted into boxes formed from a molded case insert.

Accordingly, it would be desirable to provide a dart carrying case which permits shipment of the darts intact and which permits display of the darts without the need to modify the case used during shipment.

SUMMARY OF THE INVENTION

The present invention provides a dart carrying case containing a formed insert containing two lower troughs to house dart flights of various sizes and shapes and an upper trough for housing a plurality of assembled darts. Knobs in the insert are provided within the upper trough to effect separation of the assembled darts from each other. A rod-like structure having fibers retained therein is passed through holes through the darts and cooperate with the walls of the insert to maintain the darts stationary. The points of the darts are inserted into a block which, in turn cooperates with the walls of the insert to maintain the darts stationary. The insert is positioned within a case having a removable cover which is transparent. The case can be provided with a means for hanging the case, insert and darts for display purpose.

DESCRIPTION OF SPECIFIC EMBODIMENTS

Figure 1:
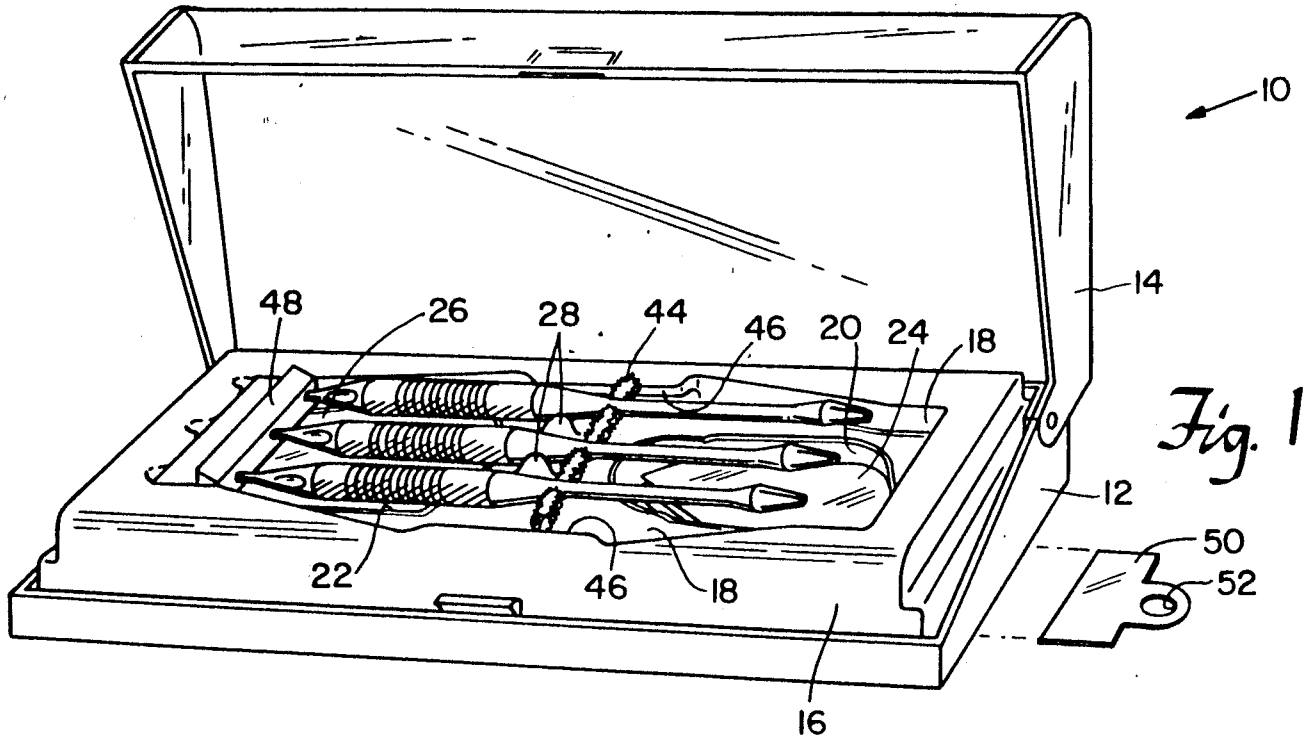
FIG. 1 is a perspective view of the carrying case structure of this invention.
Figure 2:
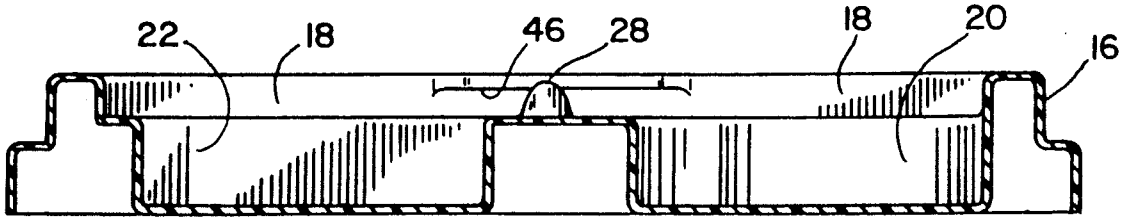
FIG. 2 is a longitudinal cross-sectional view of the insert of this invention.
Figure 3:
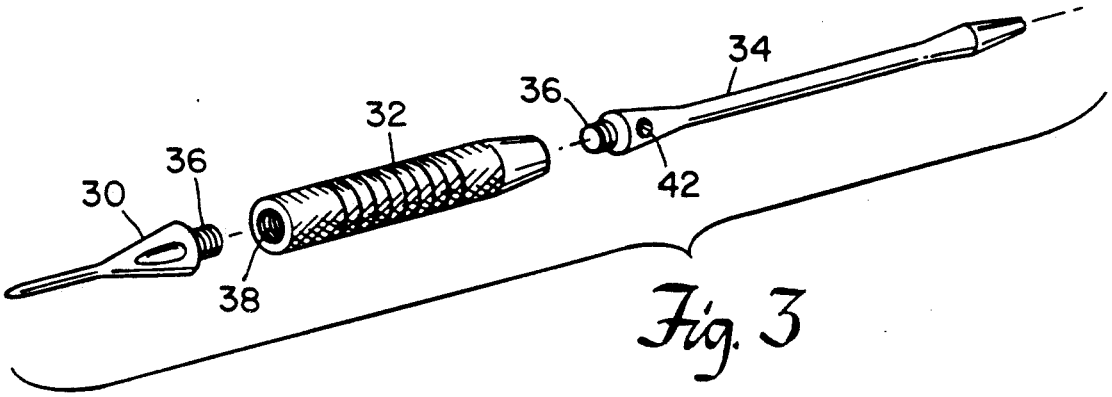
FIG. 3 is an exploded view of a dart utilized with the present invention.
Figure 4:
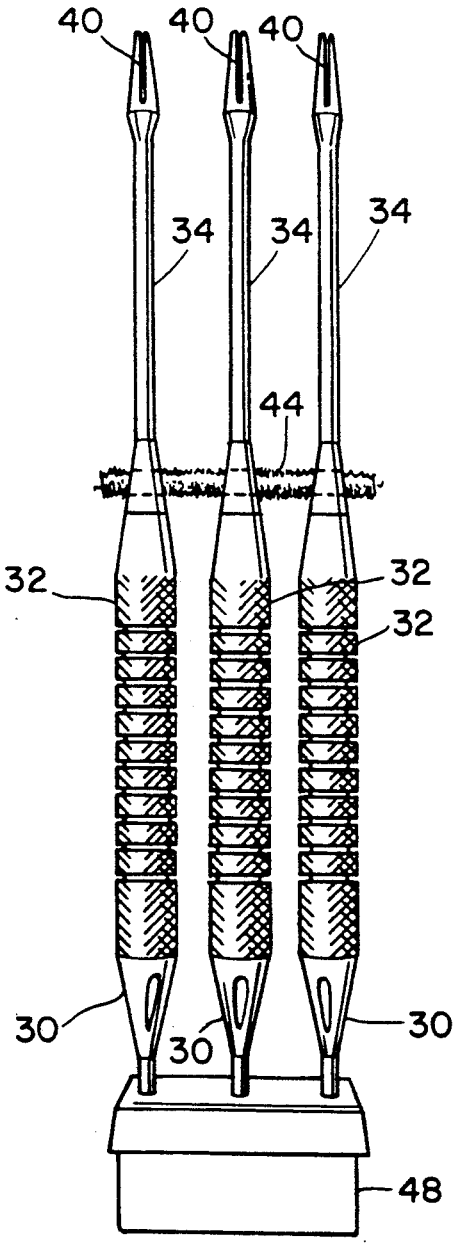
FIG. 4 is a top view of a plurality of darts arranged for placement within the insert of this invention.

The insert of this invention includes two levels of troughs. A lower level includes at least one lower trough for housing dart flights of various standard flight sizes. The upper trough has a size and shape to house a plurality of darts which are separated from each other to prevent contact between the darts. The darts are formed from a point segment, a body segment and a shaft segment. The darts are separated by inserting the point segments into a point holder. The body segments of the darts are separated by knobs formed in the insert. The shaft segments are separated by passing a rod-like structure containing fibers through holes in the shaft segments so that the shaft segments do not slide along the rod-like structure. Dart flights which fit into the shaft segments are positioned in one or two of the lower troughs while the darts, point holder and rod-like structure are positioned within the upper trough of the insert. The end of the rod-like structure can be positioned under lips formed within the insert to maintain the darts within the upper trough.

Referring to the figures, the carrying case structure 10 of this invention includes an elongated carrying case 12 having a transparent pivotally mounted cover 14. An insert 16 is positioned within the carrying case 12. The insert 16 includes an upper trough 18 and two lower troughs 20 and 22. The lower troughs 20 and 22 house dart flights 24 and 26. A plurality of knobs 28 are formed integrally with the insert 16.

The darts are formed from a point segment 30, a barrel segment 32 and a shaft segment 34 which are joined by being screwed together with screw sections 36 and threaded holes 38. The shaft segments 34 include slots 40 which accept dart flights 24 or 26. The shaft segments 40 include through holes 42 through which a rod-like structure 44 which includes fibers which fit tightly within holes 42. The structure 44 is conveniently formed from two twisted wires between which are positioned the fibers such as is utilized as commonly available pipe cleaners. The ends of the rod-like structure are positioned under lips 46 so as to retain the darts within trough 18 and away from cover 14. The point segments 30 are secured within block 48 which, in turn is positioned against the walls of upper trough 18 so that the block is retained therein by friction against the walls of the upper trough 18.

The cover 14 need not be pivotally mounted and snap fit on elongated case 12 but can be a separate piece which is then snap fit about the entire periphery of case 12 or retained thereon by any other conventional means. The entire case structure can be sealed within a transparent polymer sheet. A tab 50 can be adhered to the transparent polymer sheet so that the structure 10 can be hung upon a wall hook through tab hole 52 or the like when it is desired to display the darts for sale. Thus, the darts are retained stationary within the case structure 10 during shipment and can be displayed intact without opening the case structure 10.

We claim:

1. A carrying case for darts each formed of a point segment, a body segment and a shaft segment having through holes which comprises:

an elongated case having a transparent cover, an insert of a size to fit within said case when said cover is closed, said insert including at least one lower trough shaped to retain flights which fit into the shaft segment of said darts, an upper trough positioned between said at least one lower trough and said cover shaped to retain said darts, a block having holes adapted to accept said point segments and to fit within said upper trough, knobs formed integrally with said insert positioned to separate said body segments of said darts and a rod-like structure shaped to fit through holes in said shaft segments and to be fixedly retained within said upper trough.

2. The carrying case of claim 1 having two lower troughs.

3. The carrying case of claim 2 wherein said cover is pivotally mounted and snap fit on said case.

4. The carrying case of claim 2 wherein said cover is snap fit on said case.

5. The carrying case of claim 1 wherein said cover is pivotally mounted and snap fit on said case.

6. The carrying case of claim 1 wherein said cover is snap fit on said case.

7. The carrying case of claim 6 having two lower troughs.

* * * * *